US006808292B2

(12) United States Patent
Wong

(10) Patent No.: US 6,808,292 B2
(45) Date of Patent: Oct. 26, 2004

(54) LAMP HOLDER

(76) Inventor: Bun Wong, 7th Floor, Block 2, Leader Industrial Centre, 188-202 Texaco Road, Tsuen Wan, New Territories (HK)

( * ) Notice: Subject to any disclaimer, the term of this patent is extended or adjusted under 35 U.S.C. 154(b) by 11 days.

(21) Appl. No.: 10/340,626

(22) Filed: Jan. 13, 2003

(65) Prior Publication Data

US 2004/0136188 A1 Jul. 15, 2004

(51) Int. Cl.[7] ..... H01R 33/00

(52) U.S. Cl. ..... 362/226; 362/391; 362/396; 439/409

(58) Field of Search ..... 362/226, 249, 362/391, 396, 809; 439/409, 410

(56) References Cited

U.S. PATENT DOCUMENTS

| | | | | |
|---|---|---|---|---|
| 4,653,829 A | * | 3/1987 | LaMont | 439/409 |
| 4,874,329 A | * | 10/1989 | Yu | 439/409 |
| 5,109,324 A | * | 4/1992 | Ahroni | 362/249 |

FOREIGN PATENT DOCUMENTS

| | | |
|---|---|---|
| DE | 38 13233 A1 | 12/1988 |
| EP | 0 790 459 A2 | 8/1997 |
| EP | 0 929 132 A2 | 7/1999 |
| EP | 0 929 132 A3 | 7/2000 |
| EP | 1 199 514 A2 | 4/2002 |
| EP | 0 693 654 B1 | 10/2002 |
| FR | 2 275 842 | 4/1996 |

* cited by examiner

*Primary Examiner*—Stephen F. Husar
(74) *Attorney, Agent, or Firm*—Leydig, Voit & Mayer, Ltd.

(57) ABSTRACT

A lamp holder for comprises a socket having an axis, a part extending substantially at right angles to the axis, and at least one first snap connector; a base having an axis, a tubular stem including an inner end connected to the base, a first clamping member in the base adjacent the inner end of the stem, and at least one second snap connector engageble with the first snap connector, the socket and the base being connectable co-axially together upon being pressed against each other in a direction substantially parallel to the axes; and a second clamping member supported in the base adjacent the inner end of the stem for movement from an inoperative position to an operative position moving closer to the first clamping member; the second clamping member including a part for pressing by the socket part in a direction substantially parallel to the axes.

17 Claims, 6 Drawing Sheets

LAMP HOLDER

The present invention relates to a lamp holder for holding an electric light source, such as a light bulb or a light tube generally known as an energy saving lamp.

BACKGROUND OF THE INVENTION

Lamp holders of the type in general concerned are known, for example as disclosed in European Patent Application 98204276.4 (publication No. EP 0929132 A2). Other prior art, though less relevant, are European Patent No. EP 0693654 B1 and Publications Nos. EP 0790459 A2 and EP 1199514 A2.

The invention seeks to provide an improved lamp holder of the same general type, and a base thereof.

SUMMARY OF THE INVENTION

According to the invention, there is provided a lamp holder for holding an electric light source, comprising:

a socket for holding said light source, the socket having an axis, a part extending substantially at right angles to the axis, and at least one first snap connector;

a base for fixing to an external support, the base having an axis, a tubular stem including an inner end connected to the base, a first clamping member provided in the base adjacent the inner end of the stem, and at least one second snap connector engageable with the first snap connector wherein the socket and the base are connectable co-axially together upon being pressed against each other in a direction substantially parallel to the axes; and a second clamping member supported in the base adjacent the inner end of the stem for movement from an inoperative position to an operative position moving closer to the first clamping member for clamping an electric cable threaded through the stem into the base;

the second clamping member including a part for pressing by the socket part in a direction substantially parallel to the axes being moved to the operative position simultaneously upon the socket being pressed against the base in the same direction for connection.

Preferably, the second clamping member is a separate component of the base.

It is preferred that the second clamping member is pivotably connected to the base for pivotal movement by the socket.

It is further preferred that the base includes a pair of aligned holes, and the second clamping member is a separate component of the base and includes a pair of aligned pegs in engagement with the holes respectively thereby being hinged to the base.

It is yet further preferred that each of the holes and the corresponding peg have an inclined surface to effect engagement between them through a snap action.

Preferably, the first clamping member is fixed to the base.

More preferably, the first clamping member comprises at least one protrusion for engaging said cable.

Preferably, the second clamping member includes at least one protrusion for engaging said cable.

More preferably, the second clamping member includes a recess within which the protrusion is provided.

In a preferred embodiment, the second clamping member includes at least one spring acting upon the base thereby resiliently biassing the second clamping member towards the inoperative position.

More preferably, the spring is integrally connected with the second clamping member.

Further more preferably, the spring comprises a strip projecting from the second clamping member.

Yet further more preferably, the base has an internal corner and the spring engages with a free end thereof slidably in the corner.

More preferably, the second clamping member includes a substantially planar body having opposite sides, from which two said springs extend respectively in substantially the same direction.

Further more preferably, the body of the second clamping member includes the part for pressing by the socket part.

It is preferred that the two snap connectors comprise an inter-engageable hook and detent.

The invention also provides a base for use in a lamp holder including a socket for holding an electric light source, the base comprising:

a casing connectable in one direction with said socket;

a tubular stem having an inner end connected to the casing for fixing to an external support;

a first clamping member provided in the casing adjacent the inner end of the stem;

at least one snap connector engageable with said socket wherein the casing is connectable with said socket upon being pressed against by said socket in the opposite direction; and a separate second clamping member supported in the casing adjacent the inner end of the stem for pivotal movement from an inoperative position to an operative position pivoting closer to the first clamping member for clamping an electric cable threaded through the stem into the casing;

the second clamping member including a part for pressing by said socket in said opposite direction thereby being pivoted to the operative position simultaneously upon said socket being pressed against the casing in said opposite direction for connection.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
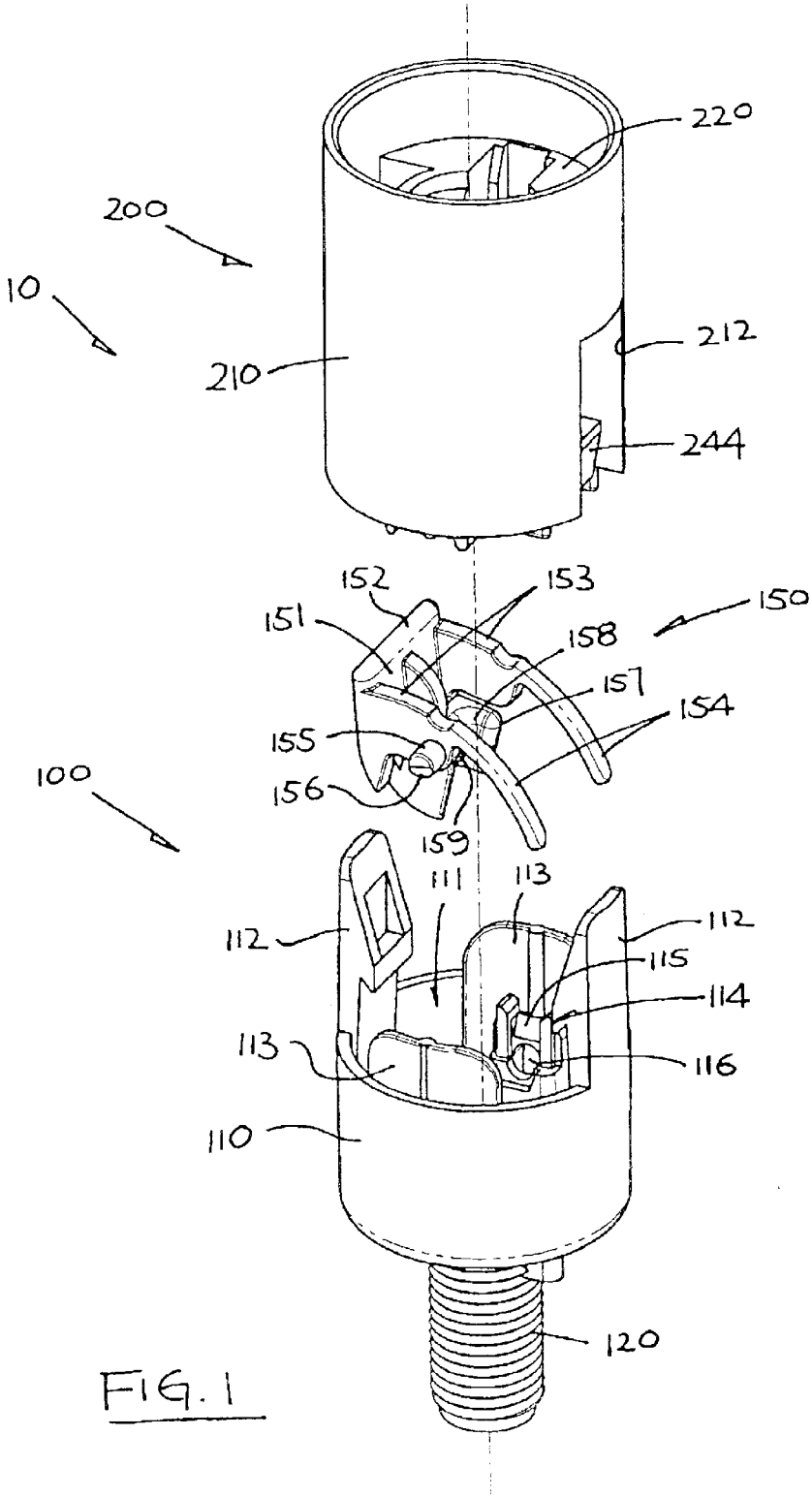
FIG. 1 is a side perspective view of a lamp holder in accordance with the invention, disassembled to show a socket and base thereof, said base including a clamping member for clamping an electric cable.
Figure 3:
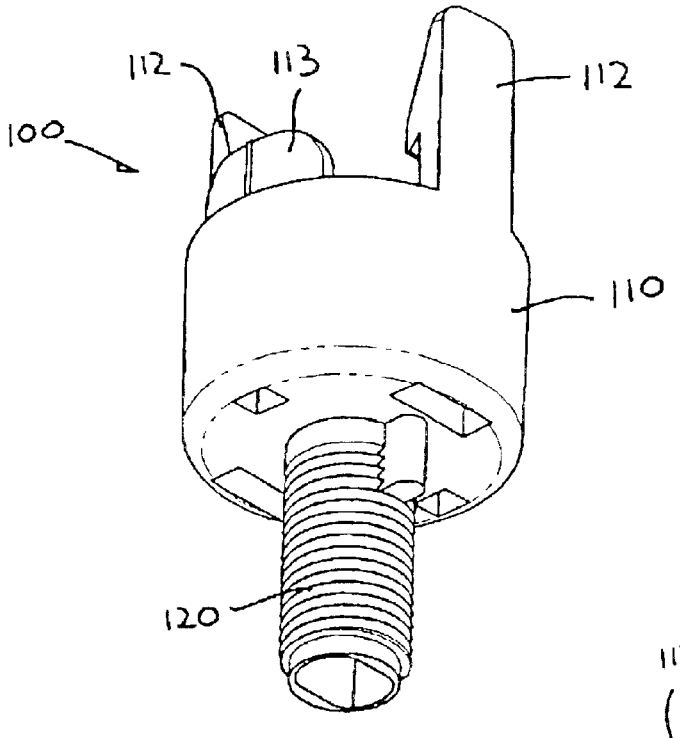
FIG. 3 is a bottom perspective view corresponding to FIG. 2, taken from below.
Figure 2:
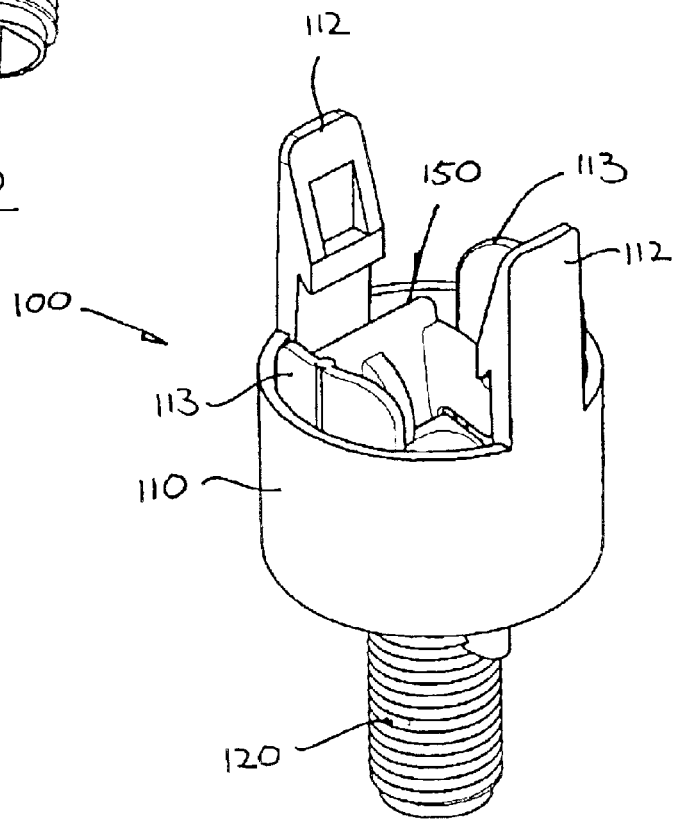
FIG. 2 is a side perspective view of the base of FIG. 1, taken from above.
Figure 4:
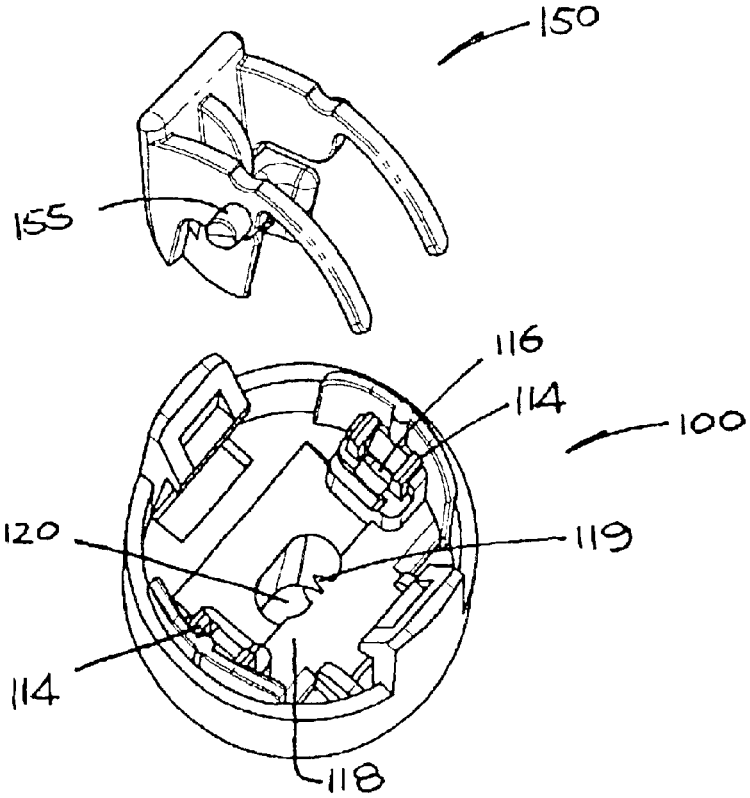
FIG. 4 is a top perspective view of the base and clamping member of FIG. 1.
Figure 5:
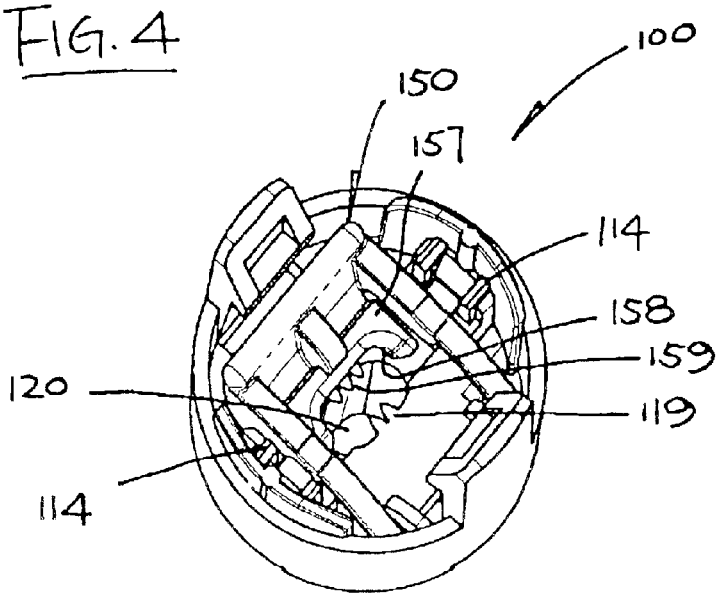
FIG. 5 is a top perspective view corresponding to FIG. 4, showing the clamping member fitted in the base.
Figure 6:
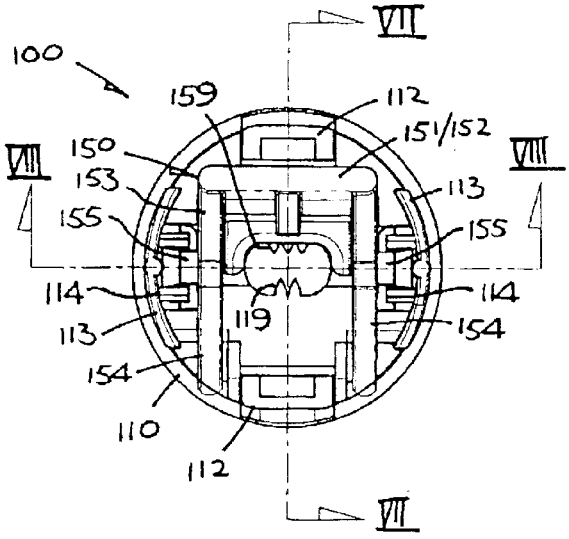
FIG. 6 is a top plan view of the base of FIG. 1.

Referring to the drawings, there is shown a lamp holder 10 embodying the invention, which comprises a socket 200 for holding a light bulb having a screw-threaded end bearing two terminals, and includes a base 100 for fixing to a support of the body of a table lamp for example. The lamp holder 10 is depicted in an upright position as its normal use position. The socket 200 has a generally cylindrical casing 210 having a vertical central axis and enclosing an internal fixture 220. The fixture 220 provides a screw-threaded seat 230 including two electrical contacts for engaging and connecting the light bulb by its end and terminals respectively, and includes a bottom structure 240.

The bottom structure 240 has a central region provided with two terminals 242 in circuit with respective contacts of the seat 230, and includes a pair of opposite side protrusions 244. The protrusions 244 are exposed through respective side slots 212 of the casing 210. In general, the structure 240 has a lowermost part or side 246, that may include a pair of parallel ribs or wall edges 248 for example, lying on an imaginary horizontal plane extending at right angles to the central axis.

The base 100 has a generally cylindrical casing 110 having a vertical central axis and including a pair of integral hooks 112 upstanding integrally from diametrically opposite sides thereof and a central tubular stem 120 depending integrally therefrom. The base casing 110 has a matching diameter as the socket casing 210 and is adapted to be connected co-axially therewith such that the hooks 112 of the former engage through respective slots 212 of the latter with the corresponding protrusions 244 acting behind the slots 212 as detents. The hooks 112 are arranged to snap with the corresponding protrusions 244, thereby connecting the base 100 and socket 200 together to form the complete lamp holder 10.

The stem 120 is formed with external screw threads, and is to be inserted through a hole in the body support of a table lamp and then fixed thereto by means of a screw nut. Through the stem 120 an electric cable 8 of the table lamp is to be threaded upwardly into the base 100 for subsequent connection to the terminals 242 of the socket 200.

The base 100 includes a separate clamping member 150 that is moulded integrally from plastic material as a single-piece component and is fitted wholly within a central recess 111 of the base casing 110. The recess 111 is defined by an upper open end of the base casing 110, from whose rim the hooks 112 project upwards alongside with a pair of lips 113 symmetrically between them, said lips 113 ensuring alignment of the two casings 110 and 210.

The lips 113 are formed, centrally on their opposing inner surfaces, with respective trunnions 114 aligned with each other. Each trunnion 114 includes an upper inclined surface 115 facing the opposite inclined surface 115 and a lower hole 116 aligned with the opposite hole 116.

The clamping member 150 has a generally upright planar body in the form of a back plate 151 having a horizontal top edge 152, and a pair of wings 153 projecting forwardly from opposite left and right side edges of the body plate 151. Each wing 153 has an extended free end that is slightly curved or bent downwards and takes the form of a relatively thin strip that is resiliently deformable to act as a cantilever spring 154. The two springs 154 project in the same direction. Immediately beyond the inner end of the spring 154, the wing 153 includes an outwardly protruding peg 155 that is aligned with the peg 155 of the opposite wing 153. Each peg 155 has a lower chamfered surface 156.

The clamping member 150 includes a bottom part 157 that is connected to the body plate 151 immediately below and extending across the two wings 153. The bottom part 157 provides a C-shaped recess 158 opening forwards, in which a series of three sharp teeth 159 is centrally formed.

The clamping member 150 is located within the base recess 111 by the trunnions 114 on opposite inner sides thereof. To do this, the clamping member 150 is pressed down into the recess 111 such that its pegs 155 are jammed laterally into axial engagement with the holes 116 of the corresponding trunnions 114. The engagement is effected through a snap action via the chamfered surface 156 of each peg 155 and the inclined trunnion surface 115 on the same side, with the corresponding wing 153 deflecting temporarily inwards.

Figure 7:
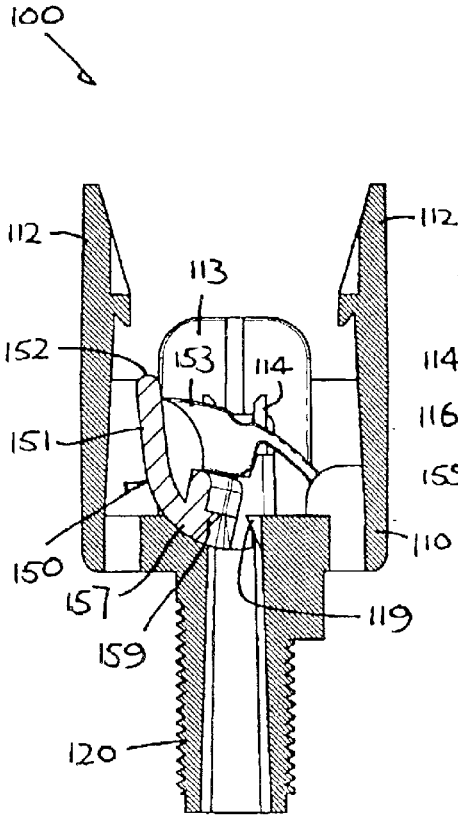
FIG. 7 is a cross-sectional view of the base of FIG. 1, taken along line VII—VII.

The clamping member 150 is hinged by the trunnions 114 for limited pivotal movement about a horizontal axis that is positioned centrally with respect to the base recess 111. The two springs 154 project to poke with their free ends slidably in respective internal corners 117 at the bottom of the recess 111, thereby resiliently biassing the clamping member 150 towards an inoperative position (FIG. 7) in which its body plate 151 lies generally upright. The springs 154 extend from near the pegs 155 to act upon the corners 117 on the side of the trunnions 114 opposite to that of the body plate 151, at the farthest possible position. Hence, the springs 154 have practically the longest possible length for maximum resilience.

The bottom of the base recess 111 includes a raised step 118 that extends laterally across the recess bottom and is level with the bottom part 157 of the clamping member 150 when the latter is located in the recess 111. The step 118 has a middle portion formed with a series of two sharp teeth 119 that are generally aligned to point at the teeth 159 of the clamping member 150. The base teeth 119 are located right within an uppermost end 122 of the base stem 120, on one inner side thereof. While the clamping member 150 is in its inoperative position, its teeth 159 are positioned just behind and clear of the opposite inner side of the stem end 122.

Figure 8:
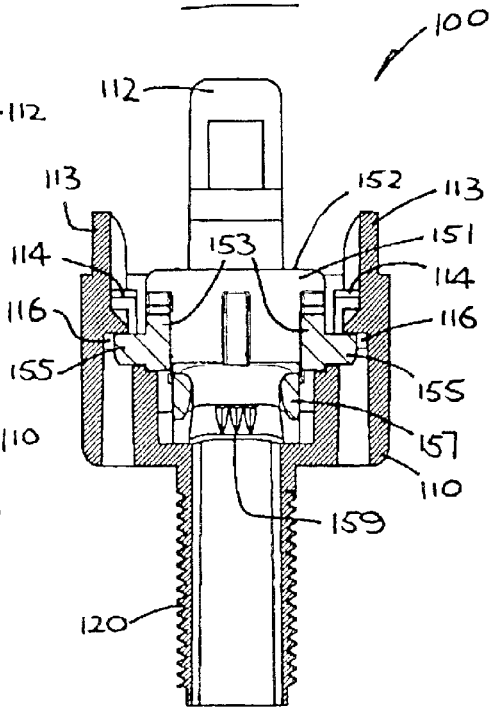
FIG. 8 is a cross-sectional view of the base of FIG. 1, taken along line VIII—VIII.

The clamping member 150 is pivotable generally downwards into an operative position (FIG. 8) against the action of its springs 154 by bending it further, such that the body plate 151 is inclined backwards to move its teeth 159 forwards closer to the fixed teeth 119. As a result, the teeth 159 intercept from one side with and partially restrict the passage of the base stem 120, at the uppermost end 122 thereof, thereby clamping in conjunction with the teeth 119 on the opposite side the electric cable 8 run through the stem 120. The opposite teeth 119, or the inner side of the stem end 122 on which they are located, may be regarded as constituting the other clamping member co-operable with the clamping member 150.

The cable 8 will be gripped by the teeth 159 and 119 on opposite sides thereof biting slightly into the insulating sheath of the cable 8. The movable teeth 159 are harboured within the C-shaped recess 158 to stop them from moving too close to the fixed teeth 119, otherwise the cable 8 may be bitten too deeply and therefore damaged. Given that the teeth 159 and 119 are asymmetrical or skewed relatively upwards, by having a horizontal upper side and an inclined lower side when viewed from either side, the cable 8 will be secured in position against being pulled out of the base stem 120 from outside.

Figure 9:
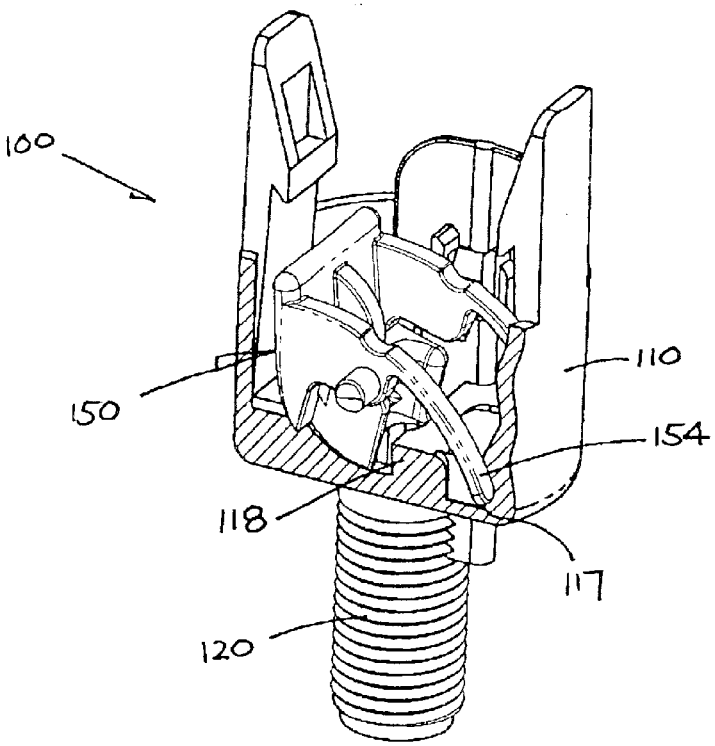
FIG. 9 is a partially broken side perspective view of the base of FIG. 2, showing the clamping member therein.

To install the lamp holder 10 to a table lamp, the cable 8 is threaded into the base 100 through its stem 120, with the base 100 fixed to the body support of the table lamp by the stem 120 using a screw nut. After the cable 8 has been connected to the terminals 242 of the socket 200, the socket 200 is pressed down onto and connected with the base 100, as described above (FIG. 9).

Figure 10:
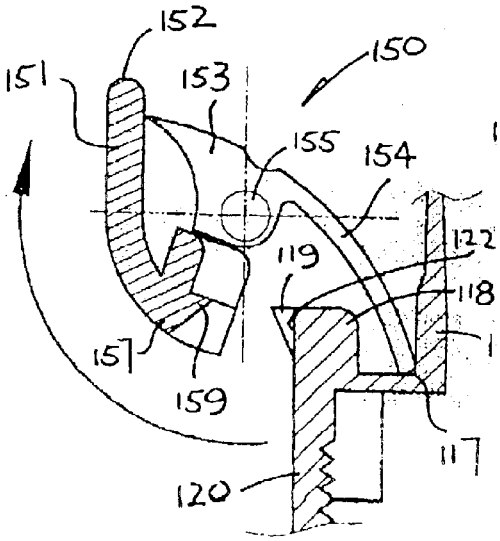
FIG. 10 is a schematic side view of the clamping member and part of the base of FIG. 9, showing the clamping member in an inoperative position.
Figure 11:
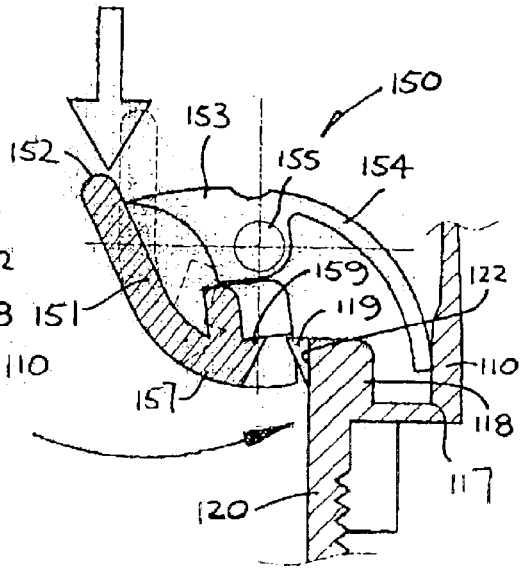
FIG. 11 is a schematic side view corresponding to FIG. 10, showing the clamping member in an operative position.
Figure 12:
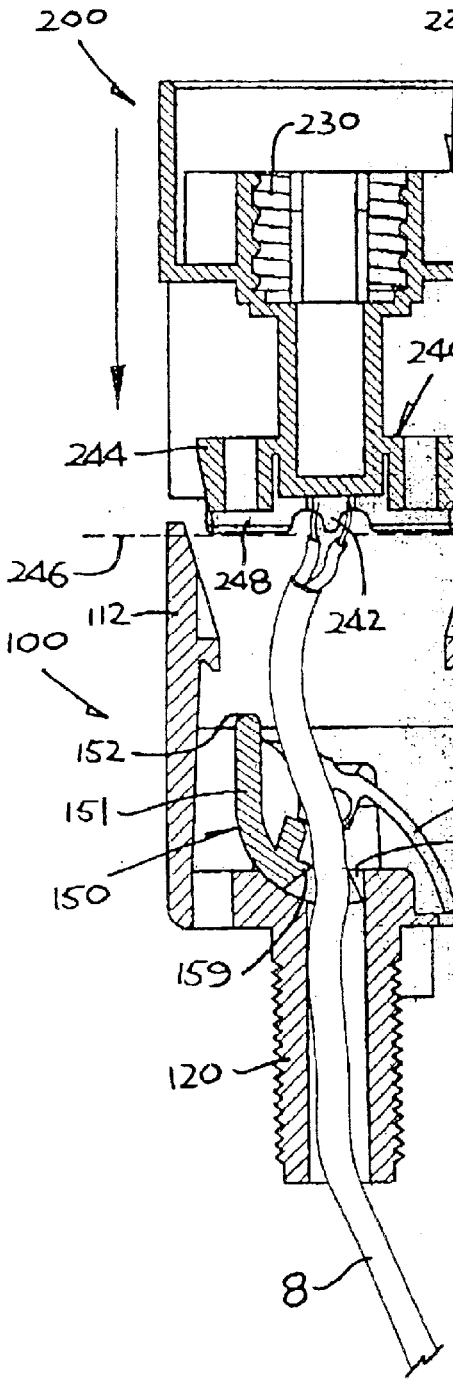
FIG. 12 is a cross-sectional side view of the lamp holder of FIG. 1, showing the clamping member in the inoperative position of FIG. 10 and how an electric cable is threaded through the base.
Figure 13:
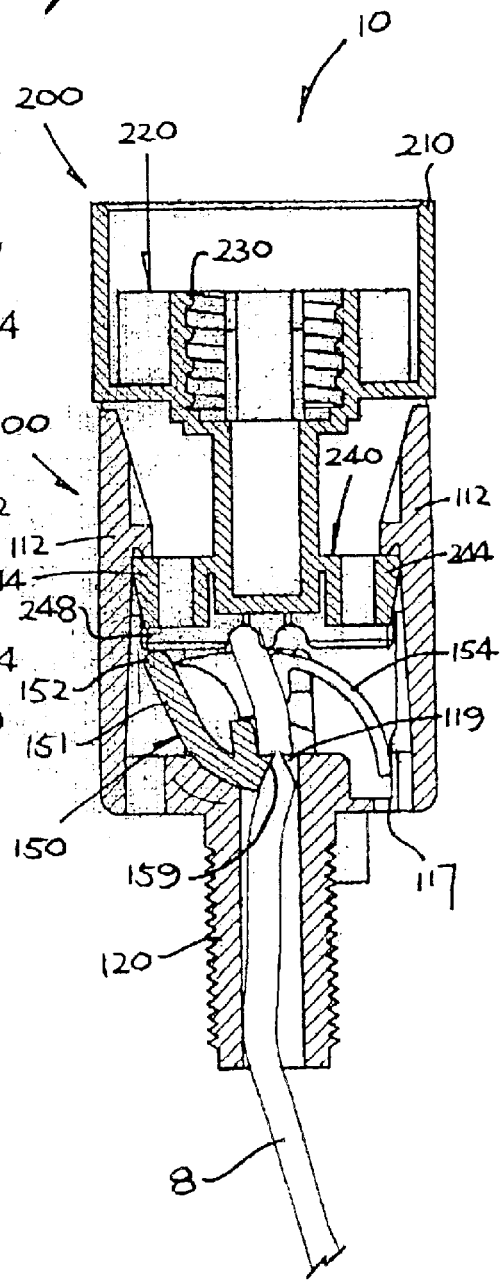
FIG. 13 is a cross-sectional side view corresponding to FIG. 12, showing the clamping member in the operative position of FIG. 11 clamping the cable upon connection of the socket with the base.

While the socket 200 is being lowered, the horizontal bottom side 246 or ribs/edges 248 of its internal fixture 220 press vertically downwards against the clamping member 150 by the top edge 152 of its body plate 151, thereby pivoting the clamping member 150. The clamping member 150 will be pivoted backwards from its inoperative position into its operative position against the action of its springs 154, thereby gripping the cable 8 at a position at the innermost end 122 of the base stem 120, as described above (FIG. 10). The cable 8 will be clamped automatically upon the socket 200 being snapped fitted with the base 100, whereupon the installation of the lamp holder 10 is completed.

The bottom ribs/edges 248 of the socket fixture 220 press vertically downwards against the clamping member 150, in a direction parallel to that in which the base 100 and socket 200 are snapped together by their connectors 112 and 244. On the other hand, the teeth 159 and 119 grip the cable 8 in a horizontal direction that is perpendicular to the vertical direction. Thus, the cable gripping force and any stress resulting therefrom as caused by pulling of the cable 8 will not affect the connection between the base 100 and the socket 200.

It is envisaged that the teeth 159 and 119 may be replaced by any other types of gripping protrusions such as ribs. They may even be omitted, in which case the clamping member part 157 and the middle portion of the base recess step 118 may be positioned at different levels to provide an S-shaped locking arrangement.

The invention has been given by way of example only, and various other modifications of and/or alterations to the described embodiments may be made by persons skilled in the art without departing from the scope of the invention as specified in the appended claims.

What is claimed is:

1. A lamp holder for holding an electric light source, comprising:

a socket for holding said light source, the socket having an axis, a part extending substantially at right angles to the axis, and at least one first snap connector;

a base for fixing to an external support, the base having an axis, a tubular stem including an inner end connected to the base, a first clamping member provided in the base adjacent the inner end of the stem, and at least one second snap connector engageable with the first snap connector wherein the socket and the base are connectable co-axially together upon being pressed against each other in a direction substantially parallel to the axes; and a second clamping member supported in the base adjacent the inner end of the stem for movement from an inoperative position to an operative position moving closer to the first clamping member for clamping an electric cable threaded through the stem into the base;

the second clamping member including a part for pressing by the socket part in a direction substantially parallel to the axes thereby upon the second clamping member being moved to the operative position simultaneously upon the socket being pressed against the base in the same direction for connection.

2. The lamp holder as claimed in claim 1, wherein the second clamping member is a separate component of the base.

3. The lamp holder as claimed in claim 1, wherein the second clamping member is pivotably connected to the base for pivotal movement by the socket.

4. The lamp holder as claimed in claim 3, wherein the base includes a pair of aligned holes, and the second clamping member is a separate component of the base and includes a pair of aligned pegs in engagement with the respective holes.

5. The lamp holder as claimed in claim 4, wherein each of the holes and the corresponding peg have an inclined surface to effect engagement between them through a snap action.

6. The lamp holder as claimed in claim 1, wherein the first clamping member is fixed to the base.

7. The lamp holder as claimed in claim 6, wherein the first clamping member comprises at least one protrusion for engaging said cable.

8. The lamp holder as claimed in claim 1, wherein the second clamping member includes at least one protrusion for engaging said cable.

9. The lamp holder as claimed in claim 8, wherein the second clamping member includes a recess within which the protrusion is provided.

10. The lamp holder as claimed in claim 1, wherein the second clamping member includes at least one spring acting upon the base and resiliently biassing the second clamping member towards the inoperative position.

11. The lamp holder as claimed in claim 10, wherein the spring is integrally connected with the second clamping member.

12. The lamp holder as claimed in claim 11, wherein the spring comprises a strip projecting from the second clamping member.

13. The lamp holder as claimed in claim 12, wherein the base has an internal corner and the spring has a free end slidably engageable with the corner.

14. The lamp holder as claimed in claim 10, wherein the second clamping member includes a substantially planar body having opposite sides, from which two said springs extend respectively in substantially the same direction.

15. The lamp holder as claimed in claim 14, wherein the body of the second clamping member includes the part for pressing by the socket part.

16. The lamp holder as claimed in claim 1, wherein the first and second snap connectors comprise an inter-engageable hook and detent.

17. A base for use in a lamp holder including a socket for holding an electric light source, the base comprising:

a casing connectable in one direction with said socket;

a tubular stem having an inner end connected to the casing for fixing to an external support;

a first clamping member provided in the casing adjacent the inner end of the stem;

at least one snap connector engageable with said socket wherein the casing is connectable with said socket upon being pressed against by said socket in the opposite direction; and a separate second clamping member supported in the casing adjacent the inner end of the stem for pivotal movement from an inoperative position to an operative position pivoting closer to the first clamping member for clamping an electric cable threaded through the stem into the casing;

the second clamping member including a part for pressing by said socket in said opposite direction upon the second clamping member being pivoted to the operative position simultaneously upon said socket being pressed against the casing in said opposite direction for connection.

* * * * *